US005108195A

United States Patent [19]

Perron

[11] Patent Number: 5,108,195

[45] Date of Patent: Apr. 28, 1992

[54] WASTE BAG WITH RECLOSABLE SEALING OPENING

[76] Inventor: Georgia M. Perron, 3318 Cantrell St., Holiday, Fla. 34690

[21] Appl. No.: 749,710

[22] Filed: Aug. 26, 1991

[51] Int. Cl.[5] ..... B65D 33/08; B65D 33/16

[52] U.S. Cl. ..... 383/10; 383/63; 383/95; 220/404

[58] Field of Search ..... 383/10, 35, 63, 33, 383/61, 95; 220/404, 403

[56] References Cited

U.S. PATENT DOCUMENTS

| | | | |
|---|---|---|---|
| 3,292,813 | 12/1966 | Roegner | 220/404 |
| 3,346,883 | 10/1967 | Ersek | 383/63 X |
| 3,746,215 | 7/1973 | Ausnit et al. | 383/61 X |
| 3,991,801 | 11/1976 | Ausnit | 383/61 |
| 4,691,368 | 9/1987 | Roessiger | 383/10 |
| 4,713,839 | 12/1987 | Peppiatt | 383/61 X |
| 4,948,266 | 8/1990 | Bencic | 220/404 X |

FOREIGN PATENT DOCUMENTS

| | | | |
|---|---|---|---|
| 2309419 | 11/1976 | France | 383/10 |
| 1160646 | 8/1969 | United Kingdom | 383/95 |

*Primary Examiner*—Stephen Marcus
*Assistant Examiner*—Jes F. Pascua
*Attorney, Agent, or Firm*—Harold D. Shall

[57] ABSTRACT

A waste bag for use in a waste can made up of an outer bag having bonded thereto a partial liner. The outer bag is large enough so that a portion thereof hangs out of and overhangs the waste can when the outer bag is placed therein. The partial liner is bonded to the outer bag at the location just inwardly of the overhanging portion and is tent shaped when closed. The partial liner has a male and female interlocking connection at the peak thereof to seal and reseal the partial liner.

3 Claims, 2 Drawing Sheets

WASTE BAG WITH RECLOSABLE SEALING OPENING

SCOPE AND BACKGROUND OF THE INVENTION

This invention relates to reclosable bags and more particularly to such a bag having an outer continuous liner having carrying handles at the top thereof and having a partial liner bonded within the bag below the handles, which partial liner has an interlocking arrangement at the outer end thereof with the interlocking arrangement being capable of being repeatedly opened and closed.

U.S. Pat. No. 4,877,336 teaches a bag within a bag, with the inner bag having an interlocking closure arrangement but with the outer bag merely having a pair of flaps overlapping the upper end of the bag and seving as a carrying handle for the inner bag. U.S. Pat. Nos. 4,658,989, 4,628,535 and 4,946,291 show bags within bags where the inner bag can be tied off or closed.

SUMMARY OF THE INVENTION

None of the prior art patents disclose a waste bag having an outer bag with diametrically opposed handles which outer bag is capable of being placed in a waste can and overlapping the top of the can to extend there below; and which bag has a partial liner bonded thereto at a location below the handles and terminating at a bond within the bag at a location which would be below the top of the waste can the bag is sized to fit. The outer end of the partial liner is shorter than the bag and has an interlocking male and female locking arrangement so that it can be repeatedly opened and closed to open or seal the open end of the bag. Obviously, in order to effect a seal, the partial liner must be a closed loop which is bonded to the inner surface of the bag in a band which extends throughout its length. To take the waste bag from the waste can, the interlocking seal is closed and the handles are grasped and the bag withdrawn from the can.

DETAILED DESCRIPTION OF THE INVENTION

Figure 4:
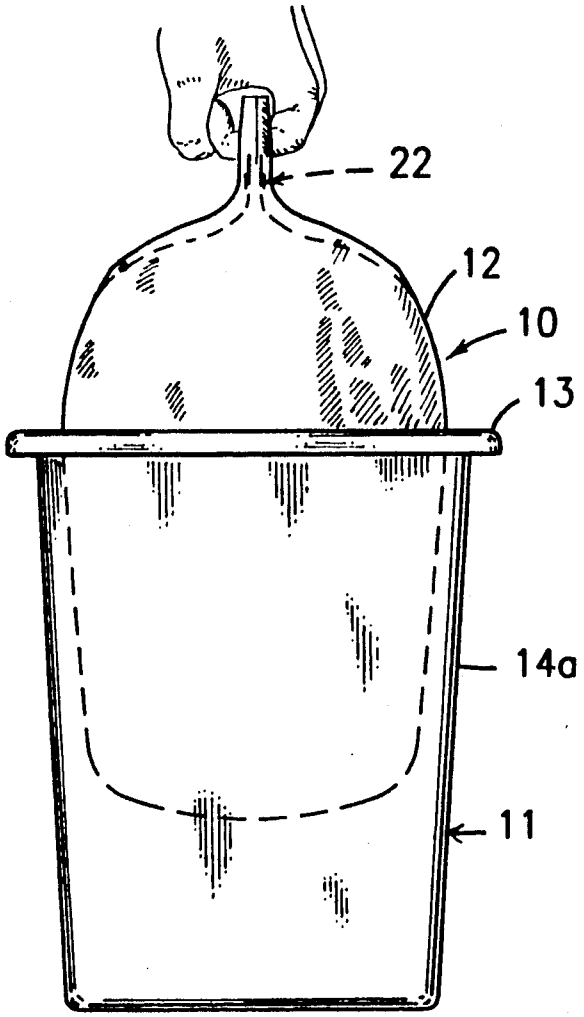
FIG. 4 is an end view of the waste bag being removed from the trash can.

Referring now to the drawings, the waste bag is shown generally at 10 disposed within a waste can 11. The waste bag 10 is sized to fit the waste can 11 and has an outer bag 12 which extends out of and entirely overlaps the top 13 and sides 14a of the waste can 11 so that a hanging portion 14 hangs down from the top 13 of the waste can 11 at the outer side thereof. Near the outer end of the hanging portion 14 is a pair of diametrically opposed handles 15 and 15a which handles serve to be suitably simultaneously grasp when the hanging portion 14 is folded up to lift the bag by hand as shown in FIG. 4.

A partial liner 16 is bonded to the outer bag 12 at the location 17 which is positioned to be just below and inwardly of the folded lip 18 of the outer bag 12, which lip folds over the top 13 of the waste can 11. Preferrably the partial liner 16 and the outer bag 12 are made of a thermoplastic material which is weldable in a suitable seam 19. The seam 19 is thermally welded in a conventional manner, such as but not limited to thermal welding, electronic welding or ultrasonic welding. The seam 19 may also be glued if desired since this seam does not carry much load but merely serves to connect the partial liner 16 to the bag 12.

Figure 2:
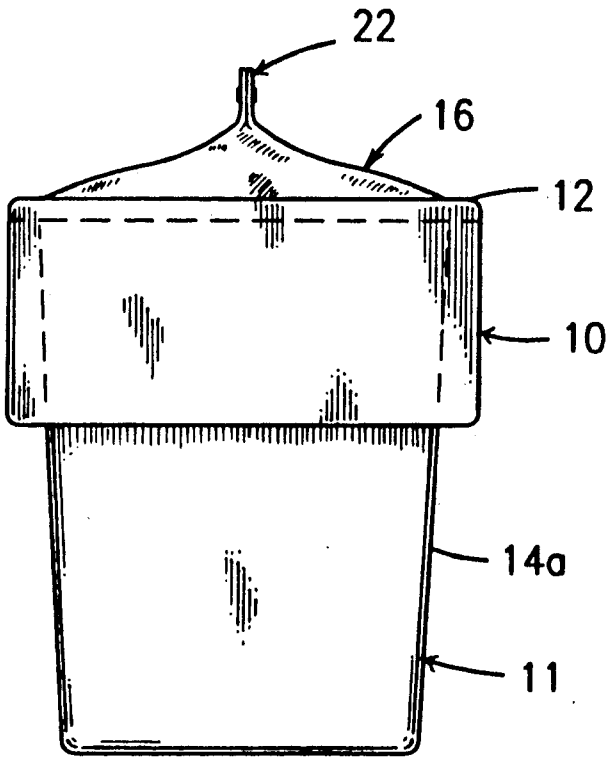
FIG. 2 is an end view of the arrangemetn of FIG. 1.
Figure 1:
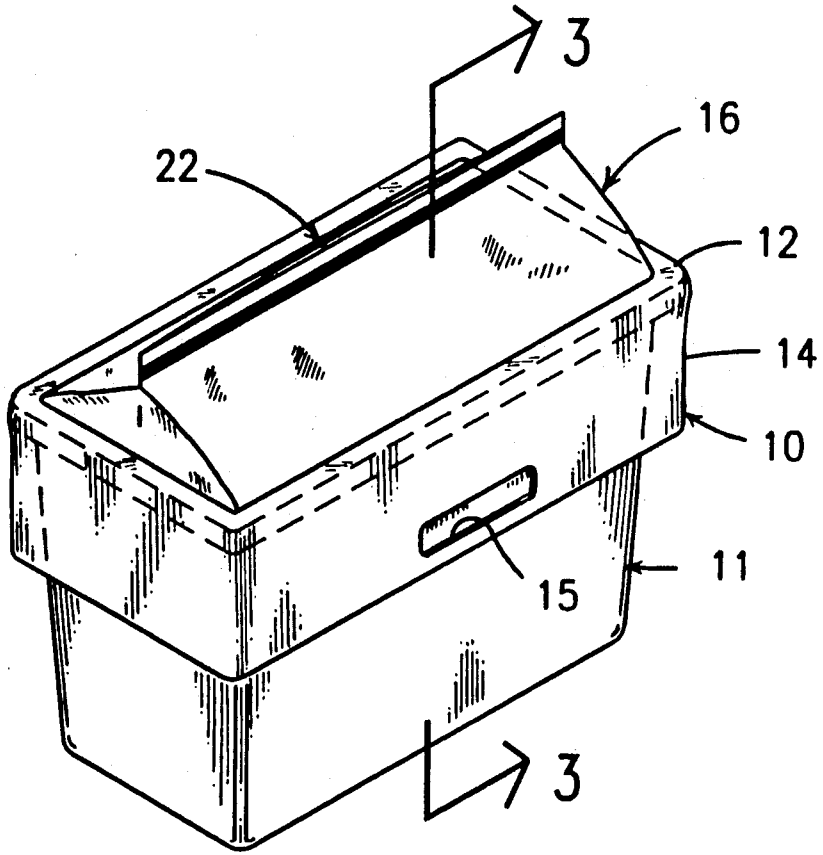
FIG. 1 is a perspective view of the waste bag of this invention positioned in a trash can.
Figure 3:
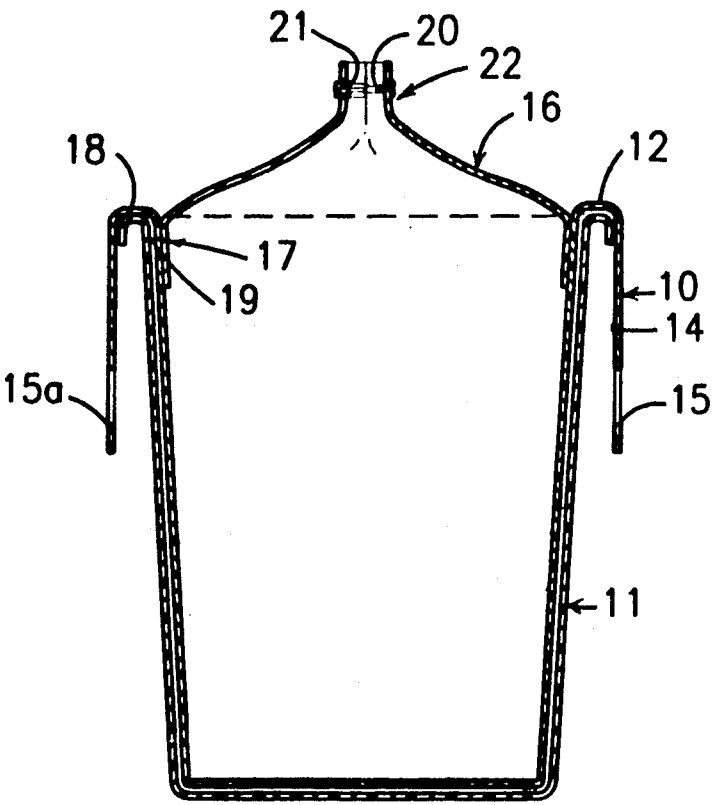
FIG. 3. is a sectional view taken along the lines 3—3 in FIG. 1.

The partial liner has a converging upper end 22 with, as seen in FIG. 3, the right side thereof having a male lip 20 projecting to the left therefrom for the full length thereof and with the left side theresof having a female groove 21 formed therein or the full length thereof; which groove receives the lip in the sealing relationship as clearly seen in FIGS. 1 and 2 so that when sealed, the partial liner 16 forms a tent shaped closure, which is not load bearing, for the outer bag 12. Since the partial liner 16 is not load bearing, it can be made of very low millage thermoplastic material, except for the lip 20 and groove 21, while the outer bag 12 which is load bearing can be made of a more sturdy millage thermoplastic material. The sealed liner 16 would prevent odors, or spillage from escaping from the sealed bag 10. The bag 10 could also be used to store clothing, blankets and the like and also to store dirty or wet clothing on the way to or from the laundrymat.

Although the above description relates to a present preferred embodiment, modifications may be made therein without departing from the spirit of this invention as defined in the following claims.

What is claimed is:

1. A trash receptacle line bag having a closed bottom and an open upper end, the upper edge of which, if the bag is flattened, is a continuous substantially straight line parallel to the bottom;

means defining handle openings in opposite sides of the bag adjacent the open end thereof;

a partial liner in the form of a closed loop of the same circumference as said bag, open at opposite ends, having one end bonded to the entire inner periphery of said bag in a band spaced inwardly from said handles and having a pair of surfaces at its opposite end, one surface having a female groove, and the other having a male lip for reclosable sealing engagement with said groove; and, whereby, when said bag is inserted in a trash can to line the interior of the can, the upper portion of the bag including the handle openings may be inverted to overlie the entire upper edge of the can and the liner may be sealed to prevent egress of odor from waste material deposited in the bag and reopened to permit deposit of additional waste.

2. The structure defined by claim 1, in which said bag and liner are both formed of plastic material and said bag being of substantially thicker stock than said liner.

3. A trash receptacle liner bag having a closed bottom and an open upper end, the upper edge of which, if the bag is flattened, is a continuous substantially straight line parallel to the bottom;

means defining handle openings and opposite sides of the bag adjacent the open end thereof; and, a partial liner of the same circumference as said bag, bonded in a band spaced from its top about its entire length to the inner periphery of said bag a point spaced inwardly from end of and completely surrounded by the upper portion of all bag walls, said liner having a pair of surfaces at its upper end, one surface having a female groove, and the other having a male lip for recloseable sealing engagement with said groove.

* * * * *

UNITED STATES PATENT AND TRADEMARK OFFICE

CERTIFICATE OF CORRECTION

PATENT NO. : 5,108,195

DATED : April 28, 1992

INVENTOR(S) : Georgia M. Perron

It is certified that error appears in the above-indentified patent and that said Letters Patent is hereby corrected as shown below:

Column 2, line 11, change "theresof" to-- thereof--.
Column 2, line 12, change "or" to--for--.
Column 2, line 30, change "line" to--liner--.

Signed and Sealed this

Twentieth Day of July, 1993

*Attest:*

Michael K. Kirk

MICHAEL K. KIRK

*Attesting Officer*

*Acting Commissioner of Patents and Trademarks*